US010179676B1

(12) United States Patent
Taylor

(10) Patent No.: US 10,179,676 B1
(45) Date of Patent: Jan. 15, 2019

(54) DISPENSER WITH SELF-CLOSING CAP

(71) Applicant: William Hagan Taylor, South Deerfield, MA (US)

(72) Inventor: William Hagan Taylor, South Deerfield, MA (US)

( * ) Notice: Subject to any disclaimer, the term of this patent is extended or adjusted under 35 U.S.C. 154(b) by 0 days.

(21) Appl. No.: 15/731,736

(22) Filed: Jul. 26, 2017

(51) Int. Cl.

| | |
|---|---|
| ***B65D 43/20*** | (2006.01) |
| ***B65D 47/14*** | (2006.01) |
| ***B65D 47/24*** | (2006.01) |
| ***B65D 55/16*** | (2006.01) |
| ***B65D 43/18*** | (2006.01) |
| *B65D 47/00* | (2006.01) |
| *B65D 43/00* | (2006.01) |

(52) U.S. Cl.
CPC ..... *B65D 43/20* (2013.01); *B65D 43/18* (2013.01); *B65D 47/141* (2013.01); *B65D 47/243* (2013.01); *B65D 47/245* (2013.01); *B65D 47/247* (2013.01); *B65D 55/165* (2013.01); *B65D 43/00* (2013.01); *B65D 47/00* (2013.01)

(58) Field of Classification Search
CPC .... B65D 43/20; B65D 47/141; B65D 47/147; B65D 47/148; B65D 47/243; B65D 47/245; B65D 47/247; B65D 55/16; B65D 55/165
See application file for complete search history.

(56) References Cited

U.S. PATENT DOCUMENTS 356,524 A * 1/1887 Clement ..... A45C 11/34 206/37
1,201,196 A * 10/1916 Kizer ..... B65D 47/265 220/375
1,366,854 A * 1/1921 Warren ..... B60K 15/0406 220/326
2,737,312 A * 3/1956 Hamlon ..... B65D 45/02 206/805
2,790,266 A * 4/1957 Williamson ..... A01K 97/05 43/55
2,913,152 A 11/1959 Vidaver
3,370,763 A 2/1968 Vranches
3,654,724 A * 4/1972 Charron ..... A01K 85/01 43/41.2

(Continued)

*Primary Examiner* — Ryan A Reis

(57) ABSTRACT

A dispenser with self-closing cap allows opening of said cap, dispensing of contents from said dispenser and closing of said cap using only one hand.

In the first embodiment, said dispenser comprises a cap, tube, base and elastic cord internally disposed between said cap and said base.

In a second embodiment said dispenser incorporates a D-ring attachment into the dispenser of the first embodiment.

Multiple dispensers of the first embodiment can be transported and stored on one's person in a caddy with integral matching boreholes to receive said dispensers.

Multiple dispensers of the second embodiment can be grouped on a split ring much as keys on a keyring.

In a third embodiment the cap of said dispenser incorporates an O-ring which guards the contents of said container against moisture or allows the storage and dispensing of gels, creams or other viscous fluids.

Said dispenser finds application in diverse areas; for example, in fly fishing for the dispensing of split shot; in the work shop for dispensing of small screws, washers, and related hardware; in the arts and craft field for the dispensing of beads, and in the medical field for the dispensing of pills.

16 Claims, 8 Drawing Sheets

(56) References Cited

U.S. PATENT DOCUMENTS

| | | | | | |
|---|---|---|---|---|---|
| 3,754,690 | A | | 8/1973 | Merchant | |
| 3,923,196 | A | | 12/1975 | Miller | |
| 4,106,664 | A | * | 8/1978 | Renk | B65D 39/00 220/315 |
| 4,679,700 | A | | 7/1987 | Tharrington | |
| 4,854,449 | A | * | 8/1989 | Fitzhugh | A44B 15/005 15/214 |
| 5,116,154 | A | | 5/1992 | Fulkerson | |
| 5,145,097 | A | * | 9/1992 | Lowe | A47G 19/24 220/375 |
| 5,199,597 | A | | 3/1993 | Gladdish | |
| 5,531,966 | A | * | 7/1996 | Brouwer | A61B 10/0038 206/446 |
| 5,921,425 | A | | 7/1999 | Markey | |
| 7,341,165 | B2 | | 3/2008 | Tippman | |
| 1,582,476 | A1 | | 6/2008 | Yoshitaki | |
| 7,513,380 | B2 | | 4/2009 | Canedo | |

* cited by examiner

DISPENSER WITH SELF-CLOSING CAP

CROSS-REFERENCE TO RELATED APPLICATIONS

This application claims the benefit of provisional patent application Ser. No. U.S. 62/493,847, filed Aug. 9, 2016, by the present inventor, the entire contents of which are incorporated herein by reference as if repeated herein.

TECHNICAL FIELD

This application relates to hand-held devices for dispensing small items and viscous fluids.

BACKGROUND

Anglers often add split shot of various weights to the end of their fishing lines. A split shot is typically a BB-size lead pellet with a groove for attachment to a line.

Split shot are available to anglers in different style containers. FIG. 1 illustrates one such container wherein container lid 12 is shown offset from container 11 for the purpose of illustration.

Container 11 comprises a series of sector shaped compartments to house split shot of different sizes. A closed-off sector in said container is the home position for rotatable container lid 12. Said lid comprises a solid disc except for a single sector opening.

In order to access a split shot the angler rotates container lid 12 so that the sector opening of said lid aligns with the sector compartment of container 11 which contains the split shot of the desired size. In this operation one hand holds said container while the other hand rotates said container lid.

Container 11 is then inverted to dispense the split shot into the hand not holding said container. Often, undesirably, more than a single split shot is dispensed. The unwanted split shot must then be picked up and put back into said container. This requires using the same hand which is holding the desired split shot.

The hand holding the desired split shot then rotates lid 12 back to its home location on container 11, the position where the open sector of said lid lines up with the closed-off sector of said container.

In this process, the split shot can easily be dropped, especially if said split shot is very tiny or if use of the hands is impaired by the cold, wetness, or other reasons such as arthritis or neuropathy of the hand.

Another issue with this type of device is that if the angler neglects to fully return the lid back to its home location, split shot will accidentally pour out of the container while said container is being returned to a pocket or, worse, left open dangling on a vest or shirt attachment.

Yet another issue is that not all the sizes of split shot offered in the commercially available containers are desired by the angler for his or her type of angling. The undesired split shot are needlessly carried around and go to waste.

The basic issue with this prior art device is that two hands are required to access the split shot. The multiple manual operations required to open and close the lid and dispense the split shot significantly increase the risk of dropping the selected split shot or, much worse, the entire split shot container.

Split shot are also available in container types different from the one shown in FIG. 1. Plastic compartment boxes with hinged lids as well as plastic bags containing split shot are also available to the angler. Both the split shot box with hinged lid and the plastic bag suffer the same deficiency as the previously discussed container with rotatable lid, namely, two hands are required to access a split shot. The issues addressed above remain.

Said issues are overcome in dispenser 21, shown in FIG. 2[.], said dispenser allowing access to split shot using only one hand.

Dispenser 21 comprises cap 22, tube 23, base 24, as shown in FIG. 2, and elastic cord 25 shown in FIGS. 3*a* and 3*b*.

Elastic Cord 25 maintains cap 22 in place atop tube 23 by the tension in said cord.

Removal of said cap from said tube requires retracting said cap out of said tube a distance equal to the difference in length between stem 27 and the starting point of chamfer 28 on said stem. For access to a split shot contained within said tube, said cap is then laterally displaced, thereby exposing a fully open aperture of said tube at tube top 29. This is shown in FIGS. 4*a*-4*e* wherein the progressive steps of cap removal are shown.

In use, tube 23 is grasped in the hand with the little finger of said hand pressing the lower end of said dispenser against the lower end of the palm of said hand while the index finger and thumb of said hand press against cap shoulder 26. See FIG. 8.

In the same motion just employed for dislodging said cap from said tube, said cap is pushed laterally away from the opening of said tube and restrained from returning to its housed position within said tube by maintaining light lateral force on said cap. Split shot can then be dispensed from said tube.

The grasp on said cap is then released allowing said cap to automatically snap back into said tube by way of the spring tension in elastic cord 25.

Thus, the operations of cap opening, split shot dispensing, and closing of said cap are performed using only one hand. Further, said cap removal involves little more than a flick of the fingers and is performed essentially instantaneously. There is little risk of dropping the acquired shot or said dispenser because many hand manipulations are not required. There is no unscrewing or rotation of dispenser lids or separate dispenser components to drop.

If more than one split shot is accidentally dispensed from said tube, said shot can be scooped out of the palm containing said shot using the tube itself as a convenient efficient scoop to scoop up and return said shot to said container. Again, only one hand is involved in performing this operation.

With dispenser 21 only those split shot sizes desired by the angler need to be carried. Different size split shots desired by the angler can be carried in a set of said dispensers.

Said dispensers can be refilled economically and without waste through bulk purchases of the desired split shot sizes.

The use of only one hand for accessing and dispensing split shot is a distinct advantage for the angler since said angler's hands are normally occupied with other related tasks. The angler has to simultaneously hold the rod and reel, hold the end of the line where the split shot will be clamped, hold the selected split shot between two fingers, and hold pliers or angler's hemostat for clamping the split shot onto the line.

The above example addresses the dispensing of split shot for angling but applications of the dispenser extend into other areas, as well: arts and crafts for the dispensing of beads; industrial assembly for the storage and dispensing of small screws, washers, nuts, and other hardware items; in the medical area for the storage and dispensing of pills, and, with certain adaptations, the storage and dispensing of creams, gels or other viscous fluids.

DRAWINGS—FIGURES

Figure 3A:
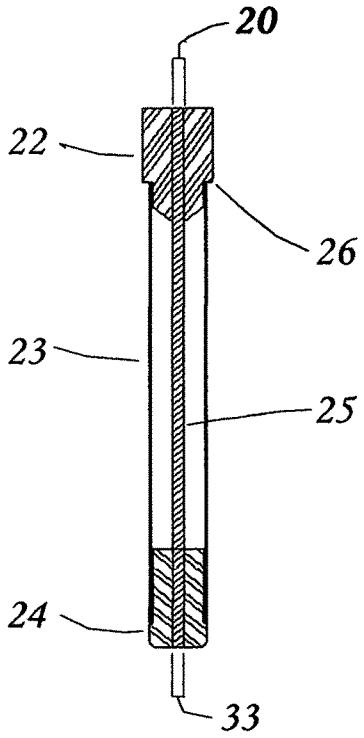

FIG. 3*a* is a sectional view of the component arrangement of said dispenser of the first embodiment.

Figure 3B:
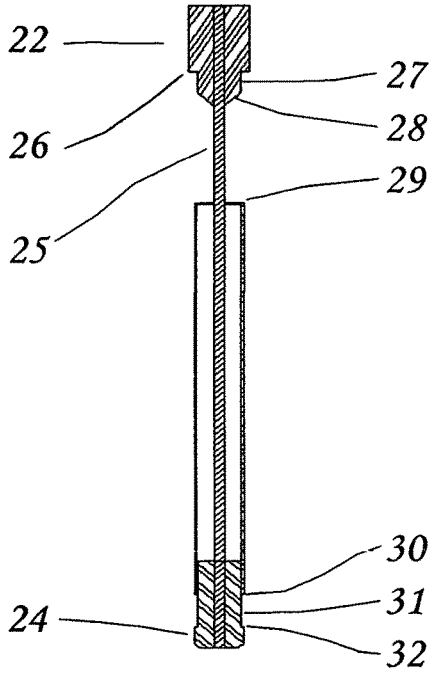

FIG. 3*b* is a sectional view of the components of said dispenser of the first embodiment with components displaced for illustration.

FIG. 4*a*-FIG. 4*e* illustrate the component arrangements of said dispenser during the opening process.

Figure 5A:
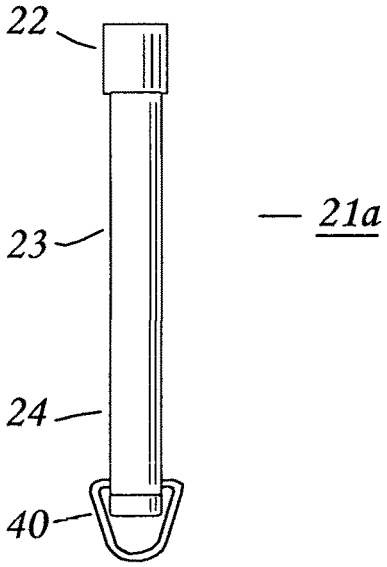

FIG. 5*a* illustrates the second embodiment of said dispenser in which a D-ring attachment is added to the dispenser of the first embodiment.

Figure 5B:
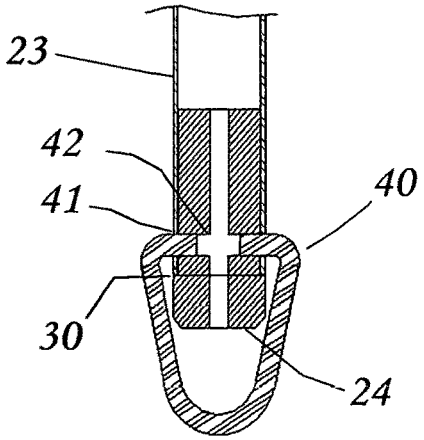

FIG. 5*b* is a sectional view of the D-ring attachment of the second embodiment.

Figure 5C:
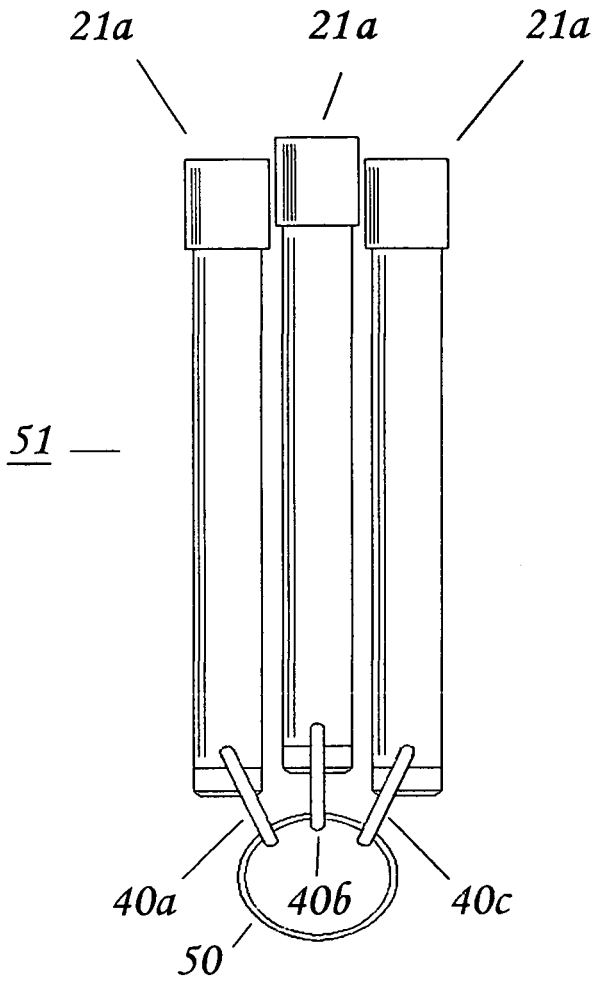

FIG. 5*c* shows a split ring means for holding and transporting the dispenser of the second embodiment.

Figure 6:
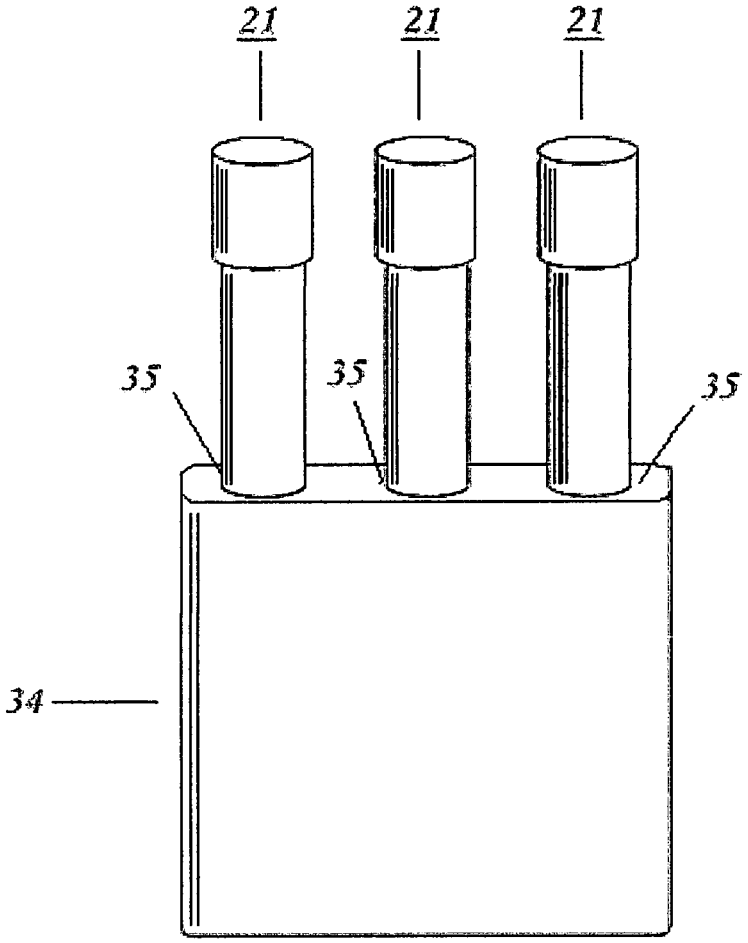

FIG. 6 shows a caddy for holding and transporting dispensers of the first embodiment.

Figure 7:
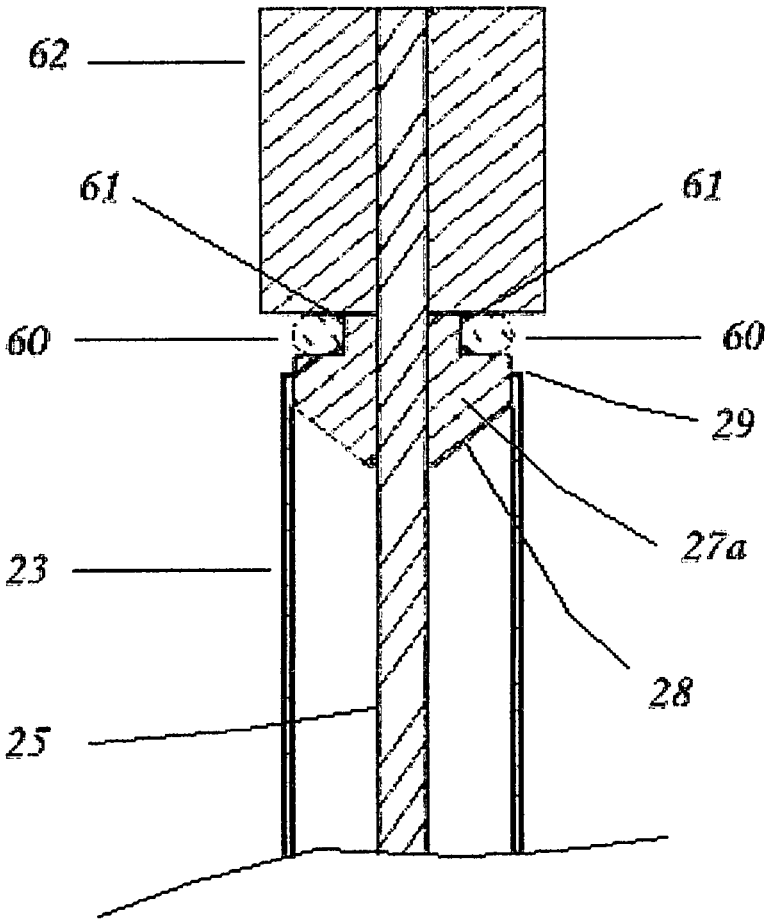

FIG. 7 is a sectional view of a third embodiment of the dispenser which includes an O-ring sealing means for the cap.

Figure 8:
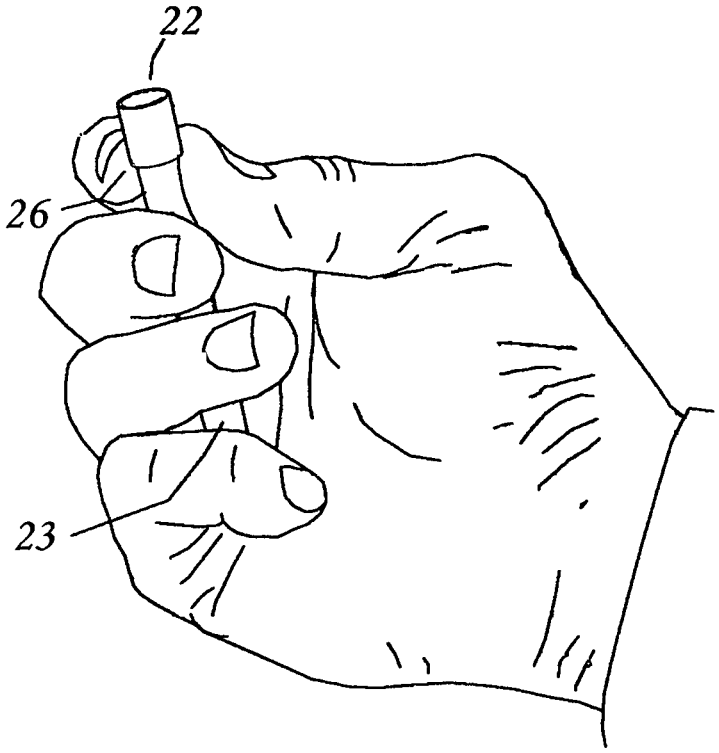

FIG. 8 is a sketch illustrating a hand holding said dispenser with fingers positioned for cap removal.

DETAILED DESCRIPTION—FIGS. 2, 3*A* AND 3*B*—FIRST EMBODIMENT

Figure 1:
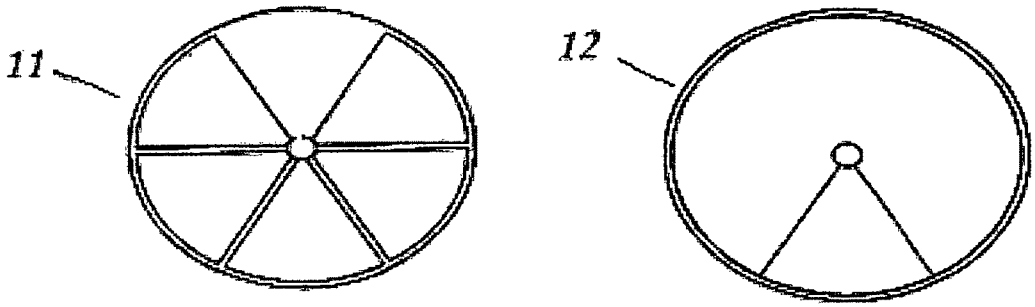
Fig 1 Prior Art
FIG. 1 illustrates a prior art example of a compartmental container for storing and dispensing split shot, container and lid separated for illustration.
Figure 2:
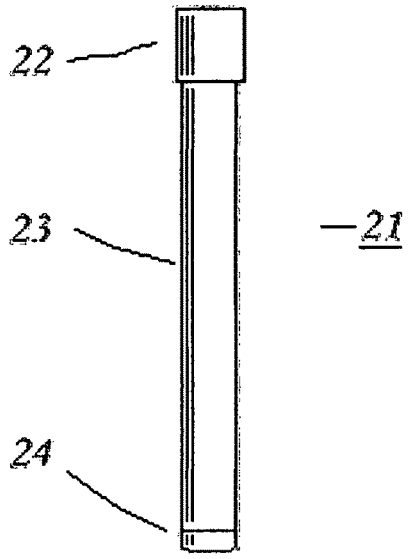
FIG. 2 illustrates the first embodiment of a new dispenser with self-closing cap.

Referring to FIG. 2, dispenser 21 comprises cap 22, tube 23, base 24, and as shown in FIG. 3*a* and FIG. 3*b*, elastic cord 25, said cord directly linking said cap to said base, as shown in FIG. 3*b*.

Said cap, tube and base are basically cylindrical in shape.

FIG. 3*a* illustrates a sectional view of the dispenser with said cap at rest within and atop said tube as determined by shoulder 26 of said cap and tension of said elastic cord.

In FIG. 3*b*, cap 22 and base 24 are shown displaced from tube 23 for the purpose of illustration. Base 24 is normally located within said tube as shown in FIG. 3*a*. Said base is positioned within said tube at tube bottom 30 by base shoulder 32, shown in FIG. 3*b*.

Base stem 31 diameter is predetermined to be slightly smaller than tube 23 inside diameter thereby permitting a tight fit of said stem to said tube. Base 24 is maintained in place via tension in cord 25. Permanent location can be effected by press fitting said base to said tube, or by crimping, cementing or pinning said tube to said base stem.

Cap 22 is shown in FIG. 3*a* at its home location atop tube top 29.

In FIG. 3*b*, cap 22 and base 24 are shown removed from tube 23 for clarity in illustration in the following discussion.

When said cap is retracted from said tube by a pulling force, said cap is under the tension of elastic cord 25. When said pulling force is relaxed, said cap is drawn back into said tube by means of tension in said cord.

Stem chamfer 28 on cap stem 27 facilitates reentry of said cap into said tube by minimizing the flat surface area on the lower end of said stem, whereby said flat surface area could snag, undesirably, atop tube top 29 instead of being pulled totally within said tube.

Chamfer 28 is nominally a 90-degree conical surface with axis of said conical surface coincident with axis of cylindrical stem 27. The transition areas between said conical surface and said cylindrical stem surface can be beveled to further facilitate retraction of said cap back into said tube.

Alternatively, chamfer 28 can be a hemispherical surface with diameter equal to stem 27 diameter. Other geometries of cap stem 27 and chamfer 28 are acceptable as long as contour of said surface does not permit snagging of stem 27 on tube top 29 during the retraction process.

Stem 27 length is maintained less than the inside diameter of tube 23 in order to facilitate clearance of said stem from said tube during removal of said cap from said tube.

Chamfer 28, advantageously, further reduces the linear excursion required to dislodge said cap from said tube. As said cap retraction from said tube reaches the junction of chamfer 28 and stem 27, as shown in FIG. 4*a*-4*e*, no further linear motion is required to dislodge said cap from said tube. At said junction a light lateral force on said cap is all that is required to push said cap clear of the opening of said tube for dispensing.

Quick, smooth retraction of said cap back into said tube also depends on tension in cord 25, the surface smoothness of chamfer 28 and, the presence of a bevel on the inside diameter of tube top 29.

Cap 22 diameter is greater than tube 23 outside diameter in order to create ample cap shoulder 26. Surface area of said shoulder is large enough for the fingers to grasp and push said cap out of said tube against tension of elastic cord 25.

Cap stem 27 diameter is amply smaller than tube 23 inside diameter in order to facilitate retraction of said cap back into said tube under tension of said elastic cord.

Cap 22 length is sufficient to permit easy, secure grasping with the fingers.

Identification markings, in the form of etchings, decals or other, of the dispensed items, can be applied to the top and cylindrical surfaces of cap 22.

Cap borehole 20 and base borehole 33 of predetermined diameters exist along the lengths of cap 22 and base 24, respectively, as shown in FIG. 3*a*, in order to accommodate said elastic cord.

Tube 23 inside diameter exceeds the sum of the diameter of the largest stored item and the diameter of elastic cord 25.

Base 24 diameter is less than tube 23 outside diameter in order to facilitate insertion and removal of dispenser 21 into a storage or transport device, said device having boreholes, slightly greater than said tube diameter.

Chamfers exist on the inside diameter of tube top 29 and tube bottom 30 to facilitate insertion of cap 22 and base 24 into tube 23 and, further, to reduce abrasive wear on elastic cord 25 as it repeatedly moves in contact with tube top 29.

Shoulder 32 on base 24 prevents unwanted retraction of base 24 into tube 23.

Predetermined diameter of stem 31 allows a tight fit with said tube. Said stem is secured to said tube via crimping, cementing or pinning.

Borehole 33 and borehole 20 of predetermined diameters exist along the axes of base 24 and cap 22, respectively, to accommodate elastic cord 25.

Predetermined diameter of elastic cord 25 ensures complete surface area contact with borehole 20 of cap 22 and borehole 33 of base 24. Said surface area contact is accompanied by sufficient radial compressive force of said cord to cause said cord to remain fixed within said boreholes by the frictional force thereby generated.

Predetermined oversize diameter of said cord anchors said cord within said boreholes after said cord becomes compressed and elongated during installation of said cord into said boreholes.

Said frictional force can be substantially increased by doubling the elastic cord within the boreholes of said cap and base Elastic cord 25, shorter than tube 23 before assembly of said cord with said cap and said base, is stretched during said assembly in order to generate tension in said cord whereby said cap is pulled tight against tube top 29.

The force by which said cap is pulled against tube top 29 is also determined by the spring constant of said cord material. Tension in said cord keeps contents of said dispenser from spilling out when said dispenser is inverted.

Lengths of borehole 20 in cap 22 and borehole 33 in base 24 generate enough surface contact area between said boreholes and said cord to securely anchor said cord within said holes through frictional force, said force being proportional to said contact area and the radial force exerted by compressed elastic cord 25, thereby obviating the need for other means to link said cord to said base and said cap.

In FIG. 3*a* and FIG. 3*b* said boreholes are shown passing entirely through cap 22 and base 24. Complete penetration of said holes through said cap and said base is not essential to the functioning of said dispenser but said full penetration boreholes can facilitate insertion of said cord into said cap and base.

In manufacture, the use of thermoplastics, for example, for tube 23 and base 24 allow merging of said tube and said base via injection-molding The total number of components for dispenser 21 is thus reduced from four to three with manufacturing costs reduced accordingly. Overmolding the cap and base over said cord is also feasible.

Where visual identification of tube 23 contents is important clear plastic or glass can be used for tube 23.

A plurality of dispensers 21 can be housed in dispenser caddy 34 said caddy having boreholes 35 to receive said dispensers, as shown in FIG. 6, for the case of three said dispensers.

Predetermined diameter of said boreholes allows easy insertion and retraction of said dispensers but no inadvertent spillage of said dispensers from said caddy when said caddy is nearly inverted.

Caddy 34 with said dispensers can be carded in a shirt or vest pocket. With the addition of a brooch pin, said caddy can be pinned to the shirt or vest. Alternately, a hook and loop closure means can be provided by sewing on a patch of either the hook or loop material to the shirt or vest and cementing in place on the rear side of said caddy the mating half of said hook and loop pair.

OPERATION—FIGS. 4A-4E—FIRST EMBODIMENT

FIGS. 4*a*-4*e* show Cap 22 in progressive positions throughout the cap removal process.

Figures 4A, 4B, 4C, 4D, 4E:
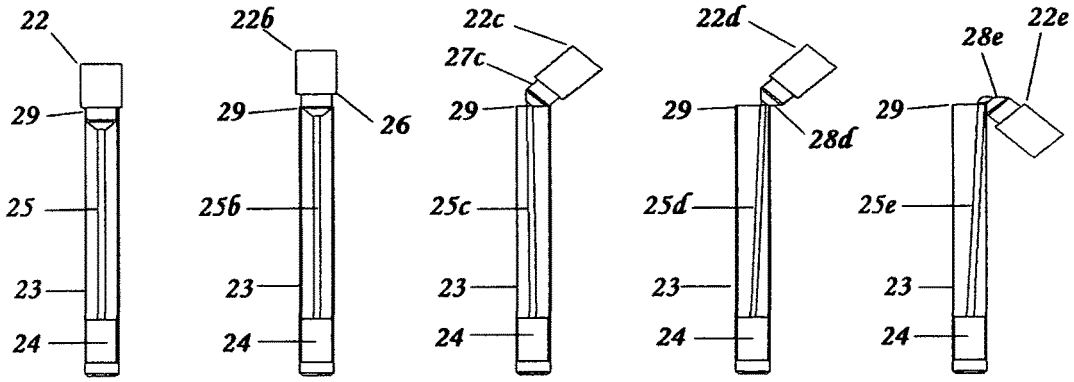

In FIG. 4*a*, cap 22, tube 23, base 24 and elastic cord 25 are shown in their nominal positions. Cap 22 is held fast to tube 23 at tube top 29 by tension in cord 25.

In FIG. 4*b*, cap 22 is shown displaced axially out of tube 23 by application of force under cap shoulder 26 in the direction of tube 23 axis. See raised cap 22*b* in FIG. 4*b*. Elastic cord 25 becomes elongated elastic cord 25*b*.

In FIG. 4*c* lateral force is applied to cap 22*b* causing said cap to rotate about the intersection of cap stem 27*c* and tube top 29. See tilted cap 22*c* in FIG. 4*c*.

Elongated elastic cord 25*b*, anchored to base 24 at the top and center of said base, undergoes incidental displacement with application of said force. See displaced elastic cord 25*c* in FIG. 4*c*.

In FIG. 4*d*, maintenance of said lateral force on cap 22*c* results in lateral displacement of said cap wherein cap chamfer 28*d* guides said cap across tube top 29. See displaced cap 22*d* in FIG. 4*d*. Elastic cord 25*d* undergoes further incidental displacement resulting from said force. See tilted elastic cord 25*d* in FIG. 4*d*.

In FIG. 4*e*, continuation of said lateral force on cap 22*d* causes rotation of said cap at the junction of the lower end of cap chamfer 28*e* and tube top 29. Cap 22*d* comes to rest when chamfer 28*e* is tangent to the exterior surface of tube 23 at the location of tube top 29. See inverted cap 22*e* in FIG. 4*e*. In this final step of the opening process, elastic cord 25 stretches, incidentally, into a U-shape at said junction. See U-shaped elastic cord 25*e* in FIG. 4*e*. The opening of tube 23 is now fully exposed for dispensing of the contents of said tube.

Said forces on said cap occur when the thumb and index finger of the hand which is holding said dispenser, as shown in FIG. 8, grasp and push said cap up and away from said tube and, lastly, said fingers restrain said cap from reentering said tube under tension of said cord.

For closure of cap 22*e*, the grasp on said cap is released thereby permitting said cap to snap back to its home position atop tube 23.

In use, said dispenser is lightly grasped with the middle, ring and little fingers, principally the little finger, while the thumb and index fingers push cap 22 out of its resting position within said tube and clear of said tube opening. Said movement of the thumb and index fingers involves only a few millimeters of travel and a fraction of a second of time.

The operation of dispenser 21 using only one hand is thus clearly demonstrated.

The sequence of steps described above are executed nearly instantaneously. Cap removal from said dispenser requires only the slight manipulation of two fingers while cap replacement is automatic.

DETAILED DESCRIPTION—FIG. 5*A*-5*C*—SECOND EMBODIMENT

In a second embodiment, dispenser 21*a* is shown in FIGS. 5*a* and 5*b* with D-ring 40 added to dispenser 21 of the first embodiment. Said D-ring is attached to said dispenser by means of borehole 41 in said tube and borehole 42 in said base as shown in FIG. 5*b*. Borehole 42 in base 24 is an extension of borehole 41 in tube 23. Said borehole passes completely through tube 23 and base 24 diametrically at a suitable distance from tube bottom 30. The diameter of said borehole is nominally equal to the diameter of the wire comprising said D-ring.

Said D-ring captivates base 24 to tube 23 thereby eliminating the need for other means to retain said base within said tube.

D-ring 40 is of the open style wherein the distance between the ends of said D-ring is initially large enough to span tube 23 diameter. FIG. 5*b* shows said D-ring in the closed position after alignment of said D-ring ends with tube D-ring borehole 41 in tube 23 and base D-ring borehole 42 in base 24 and crimping said D-ring closed.

Clearance between D-ring 40 and base 24 allows freedom of rotation of said dispenser about axis of boreholes 41 and 42.

D-ring dispensers 21*a* can be grouped together to create split ring dispenser 51 shown in FIG. 5*c* by mounting said dispensers on split ring 50. See left D-ring 40*a*, center D-ring 40*b*, and right D-ring 40*c* in FIG. 5*c*.

Alternately, a plurality of said dispensers can be grouped together using a safety pin-like spring clip in lieu of D-rings, said spring clip allowing direct pinning onto a shirt or vest.

DETAILED DESCRIPTION—FIG. 7—THIRD EMBODIMENT

A third embodiment of dispenser 21 provides for an O-ring seal between cap 22 and tube 23 thereby allowing for the secure storage and dispensing of creams, gels and other viscous fluids. See cap 62 in FIG. 7 which shows cap O-ring 60 and cap O-ring groove 61.

Said embodiment comprises cap 62, tube 23, base 24, and cord 25 as shown in FIG. 7 wherein the lower portion of said dispenser is unchanged from dispenser 21 and is thus omitted in the illustration. Cap 62 is shown partly removed from its resting position on tube top 29 for clarity.

Cap with O-ring 62 is identical to cap 22 except for the inclusion of cap O-ring groove 61 on O-ring cap stem 27*a*.

Cap O-ring 60 seats within said groove whereby a seal with the inner wall of tube 23 is created when said cap is fully inserted into said tube.

Cap O-ring 60 diameter and compressibility determine the force required to draw cap 62 fully into tube 23. Tension in elastic cord 25 is adjusted accordingly such that the self-closing feature of said dispenser is not compromised.

CONCLUSION, RAMIFICATIONS AND SCOPE

Dispenser 21 with self-closing cap allows dispensing split shot using only one hand, a big convenience for the angler whose hands are occupied holding rod and reel, end of the line, split shot and crimping pliers.

The angler can conveniently carry a plurality of dispensers having different size split shot with a dispenser caddy or split ring means of grouping together a number of dispensers incorporating D-rings.

Removal of said cap from said dispenser and dispensing contents of said dispenser can be performed with one hand, in one motion, and essentially instantaneously.

Applications of said dispenser that go beyond angling include: storage of beads and other small parts used in fly tying, jewelry making and other arts and crafts; small parts storage in the shop; pill dispensers that can be conveniently carried in a pocket or purse. offering quick access to said pills.

For applications wherein the dispensed material is a gel or cream a resilient tube material is required in order for the tube to return to its normal shape after being squeezed. Such applications would utilize said cap equipped with an O-ring.

For applications in the medical field dispenser component materials may be chosen on their ability to withstand autoclaving as well as other factors peculiar to the application. Importantly, no materials that can secrete toxic gases or fluid can be utilized in said dispenser. Fastening of components relies only on frictional forces, not glues, cements, or small fasteners.

Dispenser component shapes need not be cylindrical as the cap and tube herein have been described. For example, the cap can assume ornamental shapes to make for an attractive product with sales appeal. The storage vessel for the dispensed items can assume many geometries different than a tube as long as said vessel incorporates a tubular neck to accept the associated cap stem.

Said vessel sizes need not be restricted to those that can be hand-held. The principle of the self-closing cap described herein can be applied to larger and stationary vessels as well.

Base and cap components of said dispenser can be identical in form, fit and function, allowing access to dispenser contents from either end of said dispenser. An internal space divider can be incorporated into the tube of said dispenser said divider allowing dispensing of two different contents from said dispenser.

The elastic cord means described herein which provides the force required to make said cap self-closing can be satisfied by another type of elastic member as well such as a tension spring.

Said elastic member is nominally disposed between said dispenser cap and said dispenser base within said tube; however, the necessary tension in elastic cord 25 required for self-closing of said cap can also be achieved by other arrangements; for example, disposing said cord between said cap and wall of said tube in lieu of disposing said cord between said cap and said base.

Other spring tension means located external to said tube are possible and would provide unobstructed vessel storage space but said spring tension means would compromise the sleek, aesthetically pleasing appearance, and ergonomic shape of the innovative dispenser described herein.

Dispenser 21, in summary, is a sleek, simple, elegant device which offers ease and quickness of use.

DRAWING REFERENCE NUMERALS

| Part No. | Part Name |
|---|---|
| 11 | container |
| 12 | container lid |
| 20 | cap borehole |
| 21 | dispenser |
| 21a | D-ring dispenser |
| 22b | raised cap |
| 22c | tilted cap |
| 22d | displaced cap |
| 22e | inverted cap |
| 22 | cap |
| 23 | tube |
| 24 | base |
| 25 | elastic cord |
| 25b | elongated elastic cord |
| 25c | displaced elastic cord |
| 25d | tilted elastic cord |
| 25e | U-shaped elastic cord |
| 26 | cap shoulder |
| 27 | cap stem |
| 27a | O-ring cap stem |
| 27c | cap stem |
| 28 | cap stem chamfer |
| 28d | cap stem chamfer |
| 29 | tube top |
| 30 | tube bottom |
| 31 | base stem |
| 32 | base shoulder |
| 33 | base borehole |
| 34 | dispenser caddy |
| 35 | caddy borehole |
| 40 | D-ring |
| 40a | left D-ring |
| 40b | center D-ring |
| 40c | right D-ring |
| 41 | tube D-ring borehole |
| 42 | base D-ring borehole |
| 50 | split ring |

-continued

| DRAWING REFERENCE NUMERALS | |
|---|---|
| Part No. | Part Name |
| 51 | split ring dispenser |
| 60 | cap O-ring |
| 61 | cap O-ring groove |
| 62 | cap with O-ring |

The invention claimed is:

1. A hand-held dispenser consisting of a cap, tube, base and elastomeric member in an arrangement wherein:

a. said cap comprises a cylinder with a cap stem, whereby a cap shoulder thus formed by said cap stem, seats said cap atop said tube, with the cap shoulder contacting a tube top to limit insertion of the cap stem into the tube, b. said base comprises a cylinder with a base stem whereby a base shoulder thus formed by said base stem seats said tube on said base with the base shoulder contacting a tube bottom opposite tube top to limit insertion of the base stem into the tube, thereby creating a vessel for storing and dispensing a content through the opening at the top of said tube, c. said elastomeric member directly links said cap to said base, d. said elastomeric member maintains said cap in a rest position within and atop said tube, thereby enabling self-closing of said cap.

2. The hand-held dispenser of claim 1 wherein said cap incorporates a cap borehole axially aligned with said cap, configured to receive and hold one end of the elastomeric member.

3. The hand-held dispenser of claim 1 wherein said base incorporates a base borehole axially aligned with said base configured to receive and hold one end of the elastomeric member.

4. The hand-held dispenser of claim 1 wherein the length of said cap stem is approximately equal to the diameter of said tube, said cap stem incorporating a 45-degree chamfer comprising a conical surface with cone apex located at the center of the lower end of said cap stem, whereby said chamfer minimizes the remaining flat surface area of the lower end of said cap stem, thereby minimizing snagging of the lower end of said cap stem on the top of said tube when said cap reenters said tube after removal from said tube.

5. The dispenser of claim 1 with a D-ring attached to said tube and said base by using coaxial boreholes through the bottom end of said tube and said base, said boreholes oriented transversely to the axis of said tube, to accommodate the legs of an open style D-ring, said legs penetrating the tube and base on either side of the tube through said boreholes, whereby the open style D-ring can be securely crimped to said dispenser and whereby a plurality of said dispensers can be transported together as a unit.

6. The cap of claim 1 having an annular cap O-ring groove in said cap stem of said cap whereby a cap O-ring can be seated thereupon to create a seal with said tube.

7. A method of dispensing from a dispenser comprising:

a) grasping with a single hand a dispenser which includes a cap, cap shoulder, cap stem, base, tube with an opening atop said tube, and elastic cord wherein said cap is retained within and atop said tube by tension in said elastic cord, with the middle, ring and little fingers of said hand around the tube of said dispenser with the tips of the thumb and index fingers of said hand positioned under the shoulder of said cap of said dispenser, said thumb and index finger being in a contracted state, as if pinching, b) using the thumb and index finger, exerting a lifting force under the shoulder of said cap by extension of said contracted thumb and index finger, the application of said force being facilitated by an area of said shoulder which lies beyond said tube diameter, c) applying a lateral force to said cap after raising said cap out of said tube using the thumb and index finger in a continuation of the movement used to lift said cap out of said tube, whereby said cap pivots at the junction of a conical apex of said cap stem and said tube top thereby providing clearance to the opening of said tube, d) holding said cap clear of the opening of said tube by pinching said cap between said thumb and index finger, e) dispensing content from said tube by pouring or shaking out said content of said tube, f) closing said dispenser by relaxation of the retaining force exerted on said cap whereby said cap instantaneously snaps back into place atop and within said tube, wherein, the preceding sequence of steps are executed in a single continuous motion, requiring the use of only one hand.

8. The method of claim 7, wherein the length of said cap stem is approximately equal to the diameter of said tube, said cap stem incorporating a 45-degree chamfer comprising a conical surface extending from a point located approximately midway along the cap stem to a cone apex located at the center of the lower end of said cap stem where the cap stem joins the elastomeric member, and the step of closing said dispenser by relaxation of the retaining force exerted on said cap releases said cap under the force of the elastomeric member such that the conical surface extending from the juncture of the elastomeric member and the cap facilitates entry of the cap stem into the tube without snagging of the lower end of said cap stem on the top of said tube as said cap reenters said tube.

9. The hand-held dispenser of claim 1 wherein said elastomeric member comprises an elastic cord having a proximal end anchored within said cap borehole by the frictional force generated by the surface area contact between said cold and said cap borehole and a distal end anchored within said base borehole by the frictional force generated by the surface area contact between said cord and said base borehole.

10. The hand-held dispenser of claim 1 wherein said base and said tube comprise a single, molded component.

11. The hand-held dispenser of claim 1 wherein said base and said cap are overmolded onto the elastomeric member.

12. A hand-held dispenser comprising a cap, tube, base and elastomeric member in an arrangement wherein:

a. said cap comprises a cylinder with a cap stem, whereby a cap shoulder thus formed by said cap stem seats said cap atop said tube, with the cap shoulder contacting a tube top to limit insertion of the cap stem into the tube, the length of said cap stem being approximately equal to the diameter of said tube, said cap stem incorporating a 45-degree chamfer comprising a conical surface extending from a point located approximately midway along the cap stem to a cone apex located at the center of the lower end of said cap stem adjacent engagement of the elastomeric member with the cap, b. said base comprises a cylinder with a base stem extending into the tube, the base and the tube defining a vessel for storing and dispensing content through the opening at the top of said tube, c. said elastomeric member directly linking said cap to said base, and d. said elastomeric member maintaining said cap in a rest position within and atop said tube, said elastomeric member exerting a return force on said cap toward said rest position when said cap is removed from said tube, whereby said conical surface minimizes snagging of the lower end of said cap stem on the top of said tube when said cap stem reenters said tube under influence of the elastomeric member after removal from said tube, thereby facilitating entry of the cap stem into the tube to enable self-closing of said cap.

13. The dispenser of claim 12, whereby a base shoulder formed on said base stem seats said tube with the base shoulder contacting a tube bottom to limit insertion of the base stem into the tube.

14. The dispenser of claim 12 wherein the base and tube are integrally molded together.

15. The dispenser of claim 12 wherein the elastomeric member is insert molded into the base and cap.

16. The hand-held dispenser of claim 9 wherein the ends of said cord are doubled within the boreholes of said cap and said base thereby increasing the frictional force maintaining said cord within said boreholes.

* * * * *